US006905229B2

(12) United States Patent
Fan

(10) Patent No.: US 6,905,229 B2
(45) Date of Patent: Jun. 14, 2005

(54) LIGHT SCULPTURE

(76) Inventor: Ben Fan, 15th Fl., No. 81, Sec. 1, Hsintai 5th Rd., Hsitzu City, Taipei Hsien (TW)

( * ) Notice: Subject to any disclaimer, the term of this patent is extended or adjusted under 35 U.S.C. 154(b) by 109 days.

(21) Appl. No.: 10/646,826

(22) Filed: Aug. 25, 2003

(65) Prior Publication Data

US 2005/0047136 A1 Mar. 3, 2005

(51) Int. Cl.[7] ..... F21S 13/14

(52) U.S. Cl. ..... 362/252; 362/124; 362/806; 362/808; 428/7

(58) Field of Search ..... 362/121–124, 362/252, 806–808; 428/7; 40/442, 551, 552

(56) References Cited

U.S. PATENT DOCUMENTS 5,955,156 A * 9/1999 Hermanson ..... 428/7
6,830,361 B2 * 12/2004 Wang ..... 362/252
2004/0095751 A1 * 5/2004 Pan ..... 362/124

* cited by examiner

*Primary Examiner*—Stephen F Husar
(74) *Attorney, Agent, or Firm*—Fei-Fei Chao; Bingham McCutchen LLP

(57) ABSTRACT

A light sculpture includes a base frame made of steel wires and having a form, a light string mounted around the base frame, a supporting frame mounted on the base frame to securely sandwich the light string with the base frame, and a thermoplastic layer applied to cover the supporting frame. After the application of the thermoplastic layer on the supporting frame, light from the light string is able to penetrate the thermoplastic layer to recreate the form of the base frame.

7 Claims, 4 Drawing Sheets

LIGHT SCULPTURE

BACKGROUND OF THE INVENTION

1. Field of the Invention

The present invention relates to a general purpose light sculpture, and more particularly to a light sculpture having a form to present a three-dimensional (3D) effect. The light sculpture is provided with an outer surface which is composed of a supporting frame and a thermoplastic layer mounted on top of the supporting frame. The supporting frame is then mounted on top of a light string and the light string is subsequently mounted on top of a base frame. Therefore a year-round light sculpture is provided to be displayed outdoors or indoors.

2. Description of Related Art

It is a global custom to have all kinds light sculptures displayed outside the house to match the seasonal festivals. Some light sculptures are made of boards such as the one disclosed in U.S. Pat. No. 5,534,135, which has a board with multiple through holes defined in a distal edge of the board to correspond to light bulbs such that the entire contour of the board is illuminated by the light bulbs after the light bulbs are placed in the corresponding through holes. However, due to the material of the board being opaque, the board does not emanate enough festive spirit in the nights. In U.S. Pat. No. 5,955,156, a board made of transparent material is disclosed so that the board is able to attract the attention of passers-by. Even though this light sculpture does attract attention, the light is still limited to a two-dimensional presentation. Further, the outer surface is flat so that when the light is lit in snowing and icy winter times, the flat outer surface of the light sculpture can not reflect through the refraction from the ice. Other light sculptures may include a Santa Claus, sled and reindeers at Christmas time and a Jack-O-Lantern at Halloween. These lights may have different forms despite the material that is adopted to make the lights, but none of the light sculptures is able to present a vivid outline that is able to present different colors according to the actual model nor can allow any colors to penetrate so that a variety of vivid colors of the light would able to emanate joyful and colorful seasonal spirits.

To overcome the shortcomings, the present invention tends to provide an improved light sculpture to mitigate the aforementioned problems.

SUMMARY OF THE INVENTION

The primary objective of the present invention is to provide an improved light sculpture having a thermoplastic layer mounted on a supporting frame which is securely connected to a base frame to securely sandwich therebetween a light string so that the light from the light string is able to pass through the thermoplastic layer to show both the refraction and reflection of light. After the light is refracted and/or reflected by the thermoplastic plastic, a vivid 3D object is formed.

Another objective of the present invention is that the supporting frame is a membrane made of a transparent material to allow the light of the light string to pass through. Due to the provision of the supporting frame, the thermoplastic layer is easily employed onto the supporting frame to form a contour of an intended object.

Yet another objective of the present invention is that different colors can be implemented on the supporting frame to increase decorative effect of the object.

Other objects, advantages and novel features of the invention will become more apparent from the following detailed description when taken in conjunction with the accompanying drawings.

DETAILED DESCRIPTION OF THE PREFERRED EMBODIMENT

Figure 1:
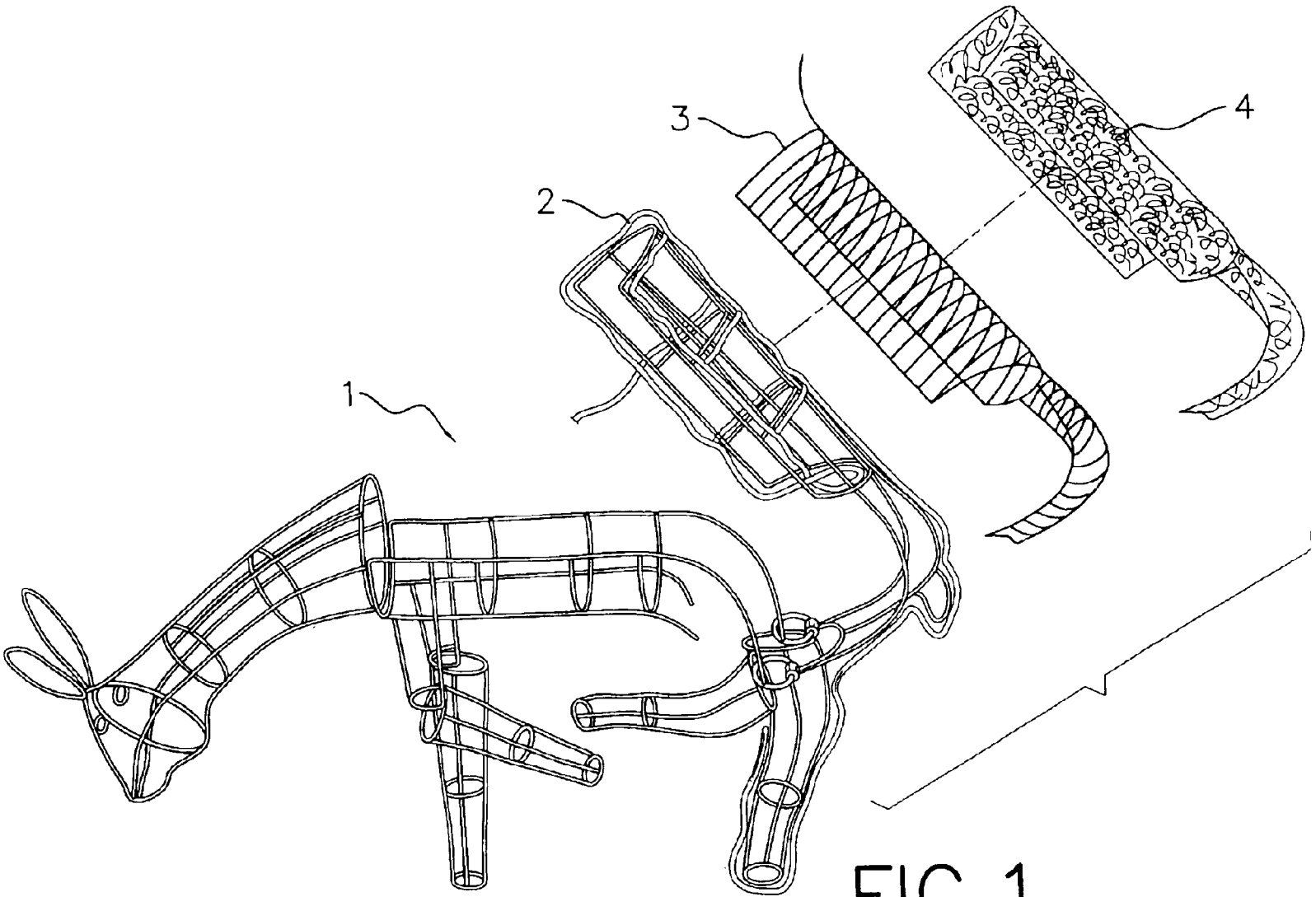
FIG. 1 is an exploded perspective view of the light sculpture of the present invention.

With reference to FIG. 1, the light sculpture in accordance with the present invention includes a base frame (1), a light string (2), a supporting frame (3) and a thermoplastic layer (4).

The base frame (1) is preferably constructed by steel wires to create a form. In the preferred embodiment shown in FIG. 1, the form of the base frame (1) is a deer.

The light string (2) also known as rope light has an outer transparent casing and multiple light emitting diodes received in the outer transparent casing. The material chosen for the outer transparent casing is resilient so that the light string is able to be wound around a contour of the base frame (1).

Figure 2:
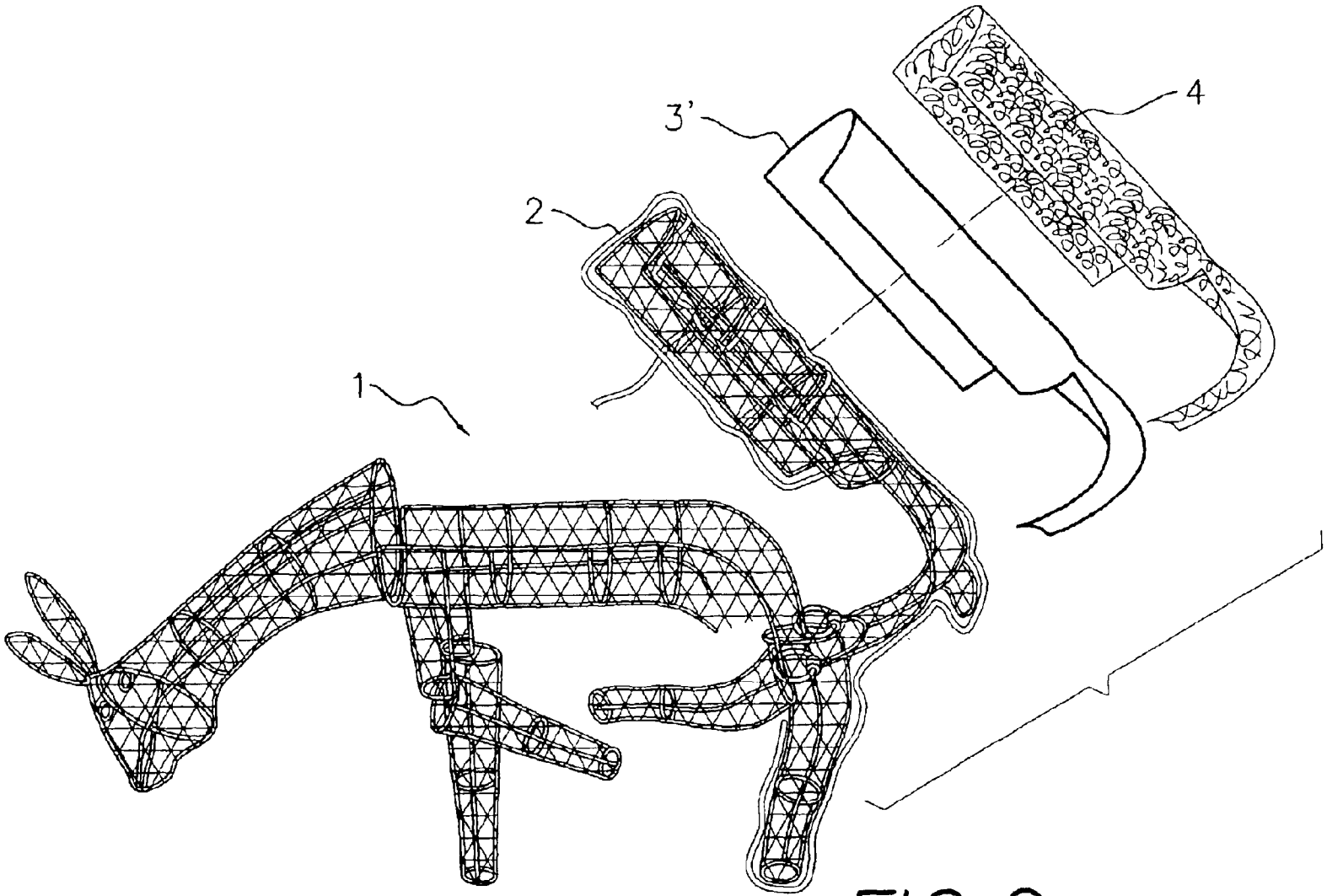
FIG. 2 is an exploded perspective view of another preferred embodiment of the light sculpture of the present invention.

The supporting frame (3) is composed of portions corresponding to portions of the base frame (1). That is, the supporting frame (3) is able to be mounted around the base frame (1) to sandwich the light string (2) therebetween. Because the base frame (1) is made by steel wires, large gaps are defined everywhere, which is disadvantageous for mounting anything thereon in that the object mounted on top of the base frame (1) is easily caved in since there is nothing to support the weight of the object. If the gaps are make smaller by using much more steel wires, the manufacture cost is high. Therefore, the supporting frame (3) is woven on the base frame (1) to fill gaps in the base frame (1) so as to facilitate the application of the thermoplastic layer. Further, because the supporting frame (3) is made of plastic and by weaving plastic strips together such that the supporting frame (3) is able to be mounted along the contour of the base frame (1). In another preferred embodiment as shown in FIG. 2, it is noted that the supporting frame (3') may be a transparent membrane which is about to be applied to cover all over the base frame (1) to sandwich therebetween the light string (2).

The thermoplastic layer (4) preferably made of polyvinyl chloride (PVC) is applied on the supporting frame (3) to cover all the supporting frame (3).

Figure 3:
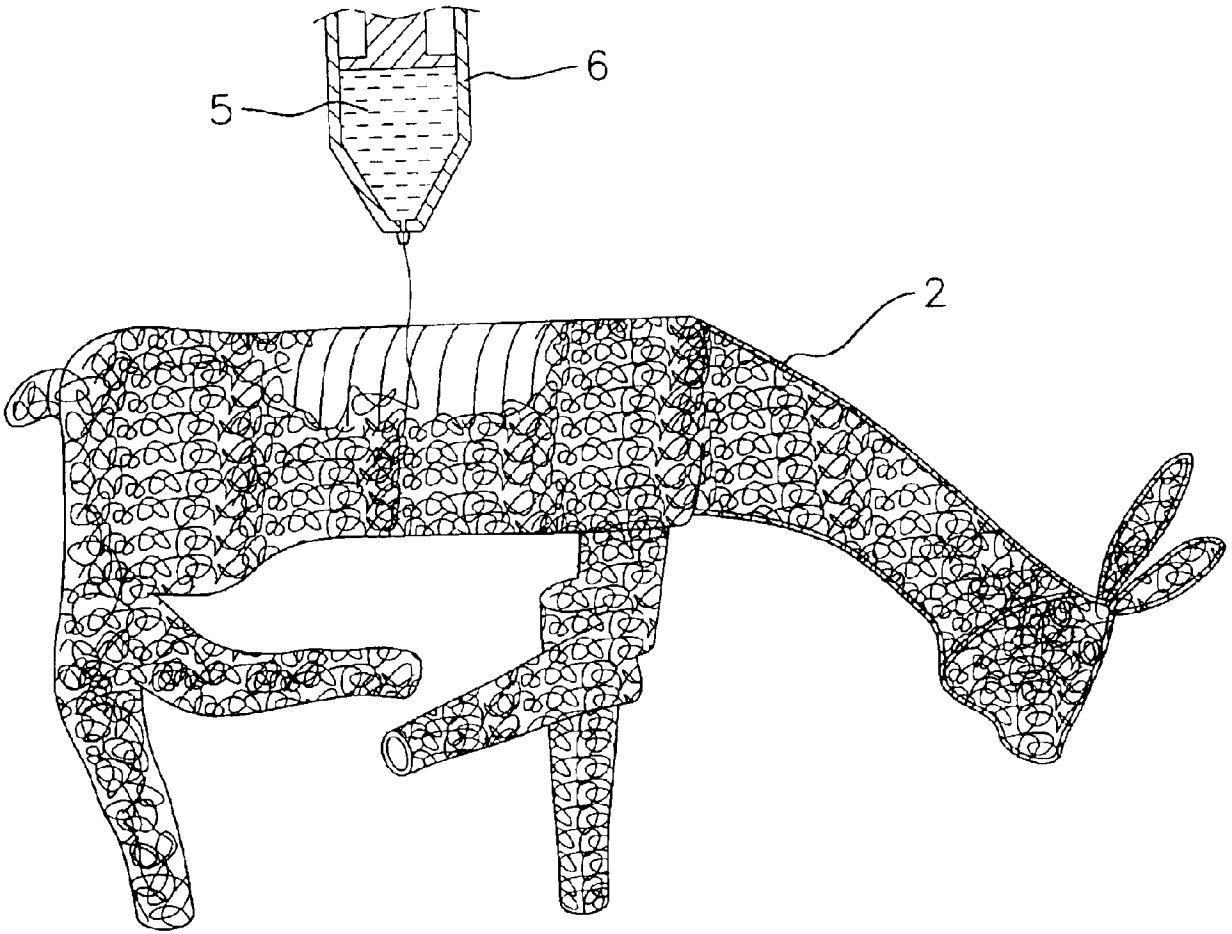
FIG. 3 is a schematic view showing the formation of the thermoplastic layer on top of the supporting frame.

With reference to FIG. 3, a thermoplastic material (5) is heated to be liquefied and then the liquefied thermoplastic is applied by a dispenser (6) on the supporting frame (3,3'). If the supporting frame (3) is made of plastic, the application of the liquefied thermoplastic covers the gaps between two adjacent steel wires of the base frame (1) to form a "skin" of the form of the base frame (1). If the supporting frame (3) is made of a transparent membrane, the application of the liquefied thermoplastic covers all the transparent membrane and all the base frame (1) to also form a "skin" to correspond to the form of the base frame (1).

Figure 4:
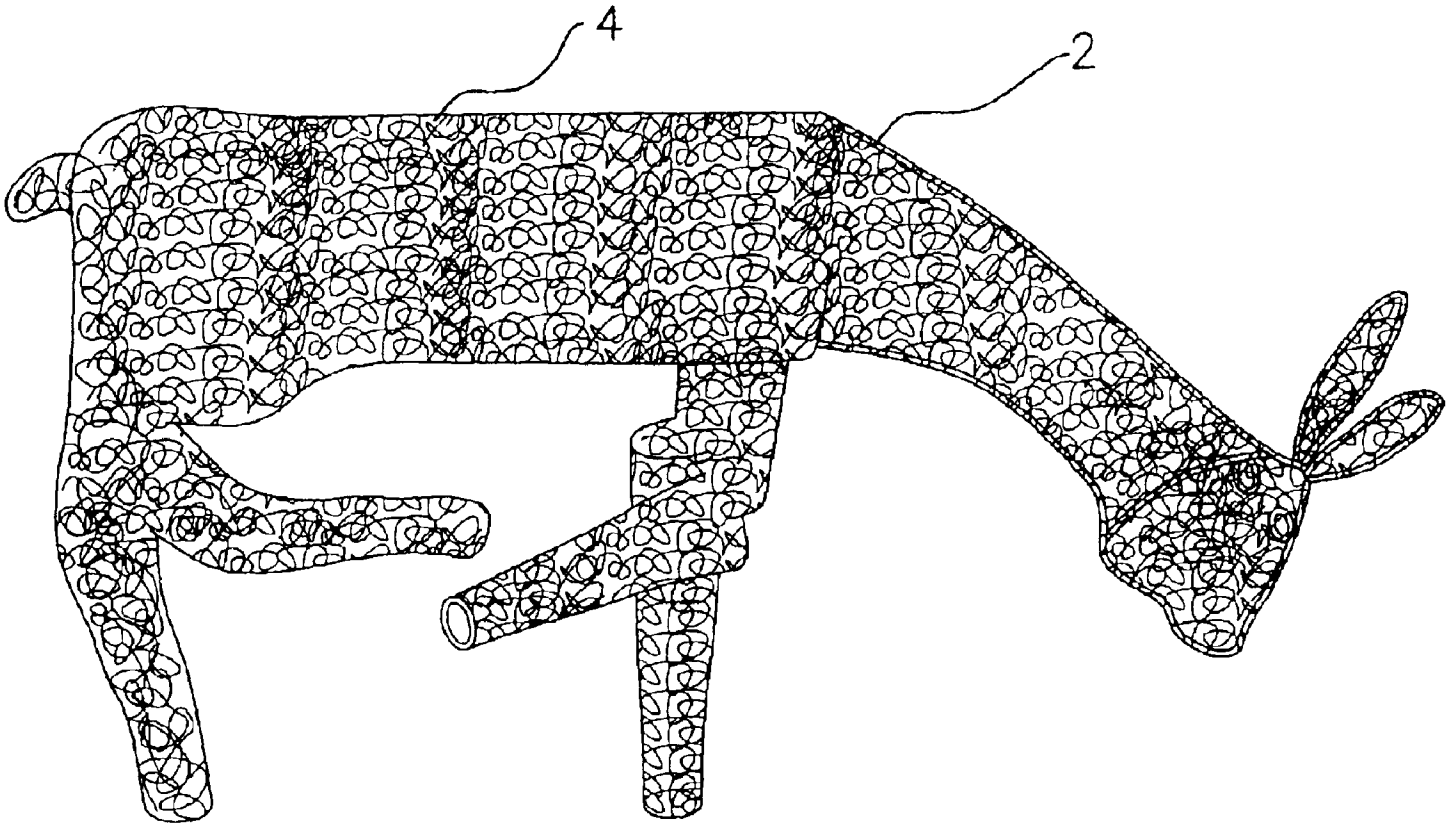
FIG. 4 is a perspective view of the finished light sculpture.

With reference to FIG. 4, after the application of the liquefied thermoplastic (5) to form a thermoplastic layer (4) on the outside of the supporting frame (3,3'), the skin of the thermoplastic layer (4) substantially covers the supporting frame (3,3').

Because the thermoplastic layer (4) is randomly formed on top of the supporting frame (3,3'), the skin is irregular in thickness and surface angle. Therefore, when the light string (2) is lit, not only is the light from the light string (2) able to pass through the thermoplastic layer (4), but also the light from the light string (2) will be reflected and refracted by the irregularity of the thermoplastic layer (4), which increases the visual effect of the light sculpture.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light sculpture comprising:

a base frame made of steel wires to have a form;

a light string mounted around the base frame;

a supporting frame mounted on the base frame to securely sandwich the light string with the base frame; and a thermoplastic layer applied to cover the supporting frame, thereby allowing light from the light string to penetrate the thermoplastic layer.

2. The light sculpture as claimed in claim 1, wherein the supporting frame is made by plastic strips woven together so that gaps defined between each two adjacent steel wires of the base frame are partially covered by the supporting frame, the application of the thermoplastic layer covers the gaps to present the form of the base frame.

3. The light sculpture as claimed in claim 2, wherein the supporting frame is a transparent membrane.

4. The light sculpture as claimed in claim 3, wherein the thermoplastic layer is liquefied before application to the supporting frame.

5. A method for making a light sculpture comprising the steps of:

preparing a base frame made of steel wires;

mounting a light string on the base frame;

applying a supporting frame on the base frame to securely sandwich therebetween the light string; and applying a thermoplastic layer on the supporting frame to recreate a form of the base frame.

6. The method as claimed in claim 5, wherein the thermoplastic layer is liquefied before application on the supporting frame.

7. The method as claimed in claim 6, wherein the thermoplastic layer is made of polyvinyl chloride.

* * * * *